US010265822B2

(12) United States Patent
Hammond

(10) Patent No.: US 10,265,822 B2
(45) Date of Patent: Apr. 23, 2019

(54) RAIL MOUNTED KNIFE AND TOOL SHARPENER

(71) Applicant: James Hammond, Birmingham, AL (US)

(72) Inventor: James Hammond, Birmingham, AL (US)

( * ) Notice: Subject to any disclaimer, the term of this patent is extended or adjusted under 35 U.S.C. 154(b) by 0 days.

(21) Appl. No.: 15/611,474

(22) Filed: Jun. 1, 2017

(65) Prior Publication Data

US 2018/0015586 A1 Jan. 18, 2018

Related U.S. Application Data

(60) Provisional application No. 62/362,953, filed on Jul. 15, 2016.

(51) Int. Cl.

| | |
|---|---|
| ***B24B 3/54*** | (2006.01) |
| ***B24B 3/36*** | (2006.01) |
| ***B24D 15/06*** | (2006.01) |
| ***B24D 15/02*** | (2006.01) |
| ***B24D 15/08*** | (2006.01) |
| ***B24B 3/60*** | (2006.01) |

(52) U.S. Cl.

CPC ..... *B24B 3/368* (2013.01); *B24B 3/60* (2013.01); *B24D 15/02* (2013.01); *B24D 15/06* (2013.01); *B24D 15/08* (2013.01); *B24D 15/081* (2013.01)

(58) Field of Classification Search

CPC ..... B24B 3/54

USPC ..... 451/45, 557–558, 555, 552, 415, 349; 76/82, 86, 88

See application file for complete search history.

(56) References Cited

U.S. PATENT DOCUMENTS

| | | | | |
|---|---|---|---|---|
| 1,032,910 A * | 7/1912 | Jackson | B24D 15/081 | 76/86 |
| 1,170,898 A * | 2/1916 | Hancock | B24D 15/081 | 451/463 |
| 1,451,526 A * | 4/1923 | Bowles | B24D 15/08 | 76/86 |
| 4,872,378 A * | 10/1989 | Wrench | B24D 15/084 | 76/86 |
| 6,101,898 A * | 8/2000 | Gore | B24D 15/065 | 76/82 |
| 2008/0171504 A1* | 7/2008 | Smith | B24B 3/54 | 451/540 |
| 2014/0273779 A1* | 9/2014 | Kotapish | B24D 15/06 | 451/552 |

* cited by examiner

*Primary Examiner* — Robert Rose

(74) *Attorney, Agent, or Firm* — Bush Intellectual Property Law; Kenneth M. Bush

(57) ABSTRACT

A portable tool sharpener adapted for mounting on a rail such as may be found on various weapons includes a sharpener body in which a plurality of sharpening tools are mounted and a rail-mounting base pivotally mounted to the sharpener body to allow the body to moved selectively to a closed and open position, wherein the rail-mounting base is releasably engageable with a rail mounted on a weapon, a handle or a fixed pad.

25 Claims, 9 Drawing Sheets

RAIL MOUNTED KNIFE AND TOOL SHARPENER

This application claims priority from U.S. Provisional Application Ser. No. 62/362,953 filed on Jul. 15, 2016.

FIELD OF INVENTION

This invention relates to portable apparatus for sharpening knives, fishhooks and other implements. In greater particularity the present invention relates to such an apparatus that may be hand held or mounted to a firearm using a rail-mounting system. In still greater particularity the apparatus relates to such an apparatus that may also be used as a hand held device or mounted to a surface such as a table, countertop, desk, or movable vehicle.

BACKGROUND

Other sharpeners have incorporated various ceramic, carbide and/or diamond feature components and configurations, either singularly or collectively, primarily configured for hand-held use. Other sharpeners feature much larger sharpening arrays, either manual or motorized, for tabletop use.

SUMMARY

This rail-mountable tool sharpener provides direct and immediate six-station access for multi-task sharpening needs in a compact, fold-up housing that is removably attached to a rail-equipped firearm, crossbow, or other device. The rail-arm handle feature quickly deploys the sharpener from its compact, folded storage mode for immediate field sharpening needs with secure control and stability under all field conditions in an off-weapon carry mode, while incorporating the easy carry option of a pocket/vest/gear mounting clip. Both of these deployment modes provide for greater user safety and hand clearance due to their firm and rigid platform stability being attached to a firearm or the rail-mount handle versus a sharpener merely being hand-held. The PALS (Pouch Attachment Ladder System) sharpener carrier clip provides secure mounting for ready-access carry on all load-bearing platforms, such as vests and backpacks. The rail-equipped knife sharpener base allows for safe and stable tabletop sharpening in the kitchen or on a workbench.

This rail mounted sharpener system is designed to be ultra-compact, incorporating sharpening solutions that exceed any other sharpener, with a mounting configuration that provides safe and ready-access functionality and usage for both the military and civilian markets. This rail mounted sharpener can be mounted on any rail-equipped military or sporting rifle, machine gun, shotgun, crossbow or other such equipped device, or carried on all load-bearing vests and backpacks, or mounted for tabletop use for ready-access knife, tool or fish hook sharpening needs. No other sharpener is as compact for ease of carry nor incorporates as many sharpening options as does this sharpener system.

BRIEF DESCRIPTION OF THE DRAWINGS

Referring to the drawings which are appended hereto and which form a portion of this disclosure, it may be seen that.

DETAILED DESCRIPTION

Figure 1:
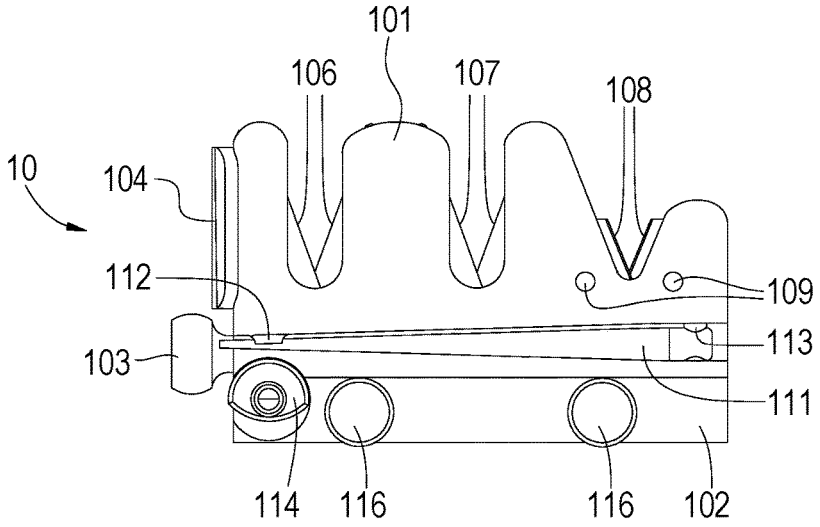
FIG. 1 is a side elevation view of the rail mounted sharpening device.

One or more of the above objects can be achieved, at least in part, by providing a multi-station rail mounted multifunctional sharpening device for knife blades, fish hooks, and other implements. Referring to FIG. 1 it can be seen that multiple components are optionally included in the device. In one embodiment of the device, a foldable assembly 10 including a sharpener housing body 101 containing multiple sharpening stations is used. The rotatable sharpener housing body 101 is rotatably mounted to a sharpener housing rail-mounting base 102 that defines a rail receiver 105 therein for selective mounting of the base 102 and rotatable housing body 101 to a rail-mounting system, such as are used on various weapons. In one embodiment, the rail receiver 105 enables the rail-mounting base 102 to be connected to a hand-held handle 20 which includes a handle body 201 and pivoting and locking rail 203.

Figure 4:
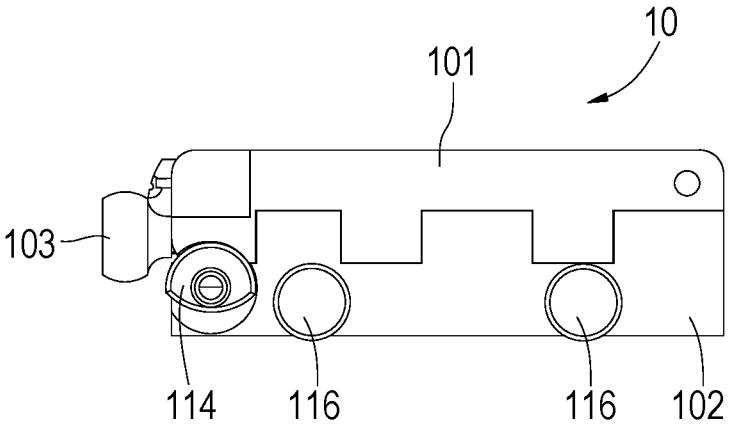
FIG. 4 is a side elevation view of the rail mounted sharpening device in a closed position.
Figure 5:
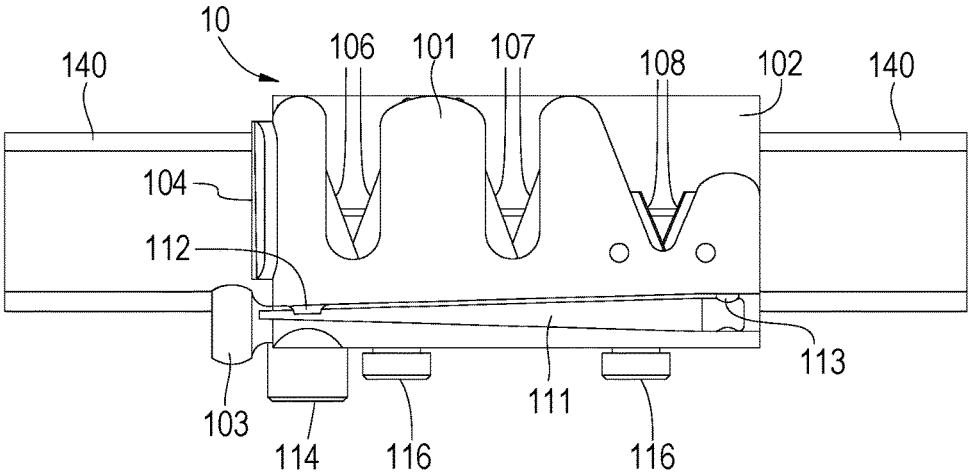
FIG. 5 is a plan view of the rail mounted sharpening device in a closed position mounted to a rail.
Figure 6:
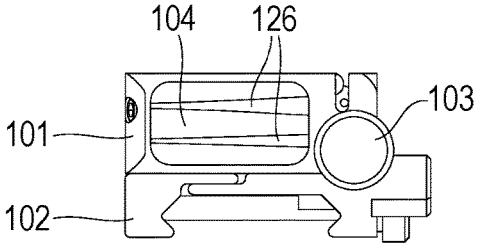
FIG. 6 is an end view of the rail mounted sharpening device in a closed position.

Referring to FIGS. 1 to 6 note that sharpener housing body 101 supports a number of sharpening elements. At one end of the housing body 101 is a diamond hook sharpening panel 104, which is also shown in FIG. 6. Sharpening panel 104 is a convex diamond coated plate and includes two tapered diamond coated grooves 126 shown in FIG. 6. Also mounted in housing body 101 are a pair of fine abrasive ceramic sharpening sticks 106 which are mounted at an angle to each other producing a 20° edge angle on both sides of a knife blade (40° included angle) drawn across the sharpening sticks 106 simultaneously. Near the middle of body 101, a pair of coarse abrasive ceramic sharpening sticks 107 are also mounted, again at an angle producing a 20° edge angle on both sides of a knife blade drawn across the sharpening sticks 107 simultaneously. Likewise, beveled carbide inserts 108 are mounted at an angle producing a 20° edge angle on both sides of a knife blade carbide inserts simultaneously. Carbide inserts 108 are held in place by insert pins 109 whereas sharpening sticks 106 and 107 are held in place by four flat point socket set screws 121, shown in FIG. 3 which allow for the removal or rotation of sharpening sticks 106 or 107 if needed.

Referring to FIG. 1, a diamond abrasive coated tapered rod 111 is mounted for rotation from within a longitudinal channel in body 101 on pivot pin 113. Tapered rod 111 which rotates outwardly from the housing for sharpening knife blade serrated edges. The diamond coating on tapered rod 111 only extends to a point just before the area of contact with a retention lip 112 on the housing body 101. To rotate the rod the user catches the tip of the rod, which extends out beyond the end of the housing, urging it laterally out of the channel and freeing it past the retention lip 112.

Figure 2:
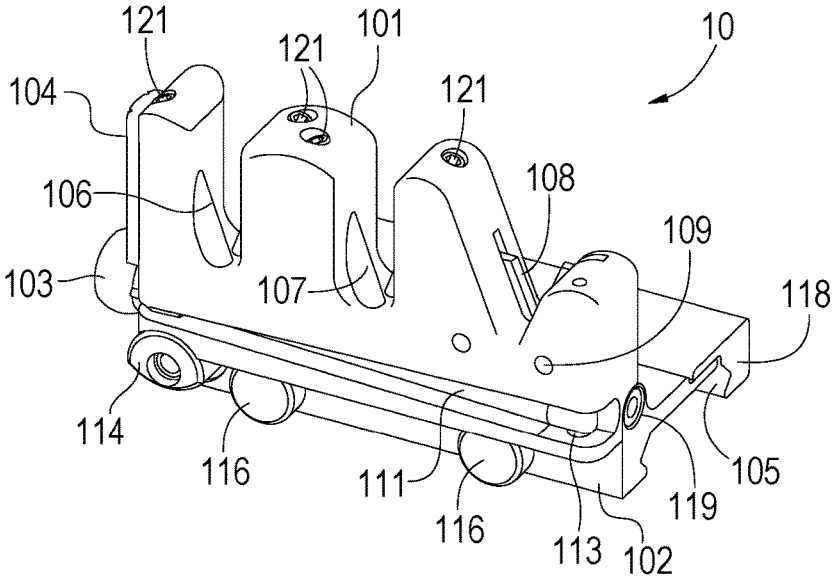
FIG. 2 is an upper perspective view of the rail mounted sharpening device.
Figure 3:
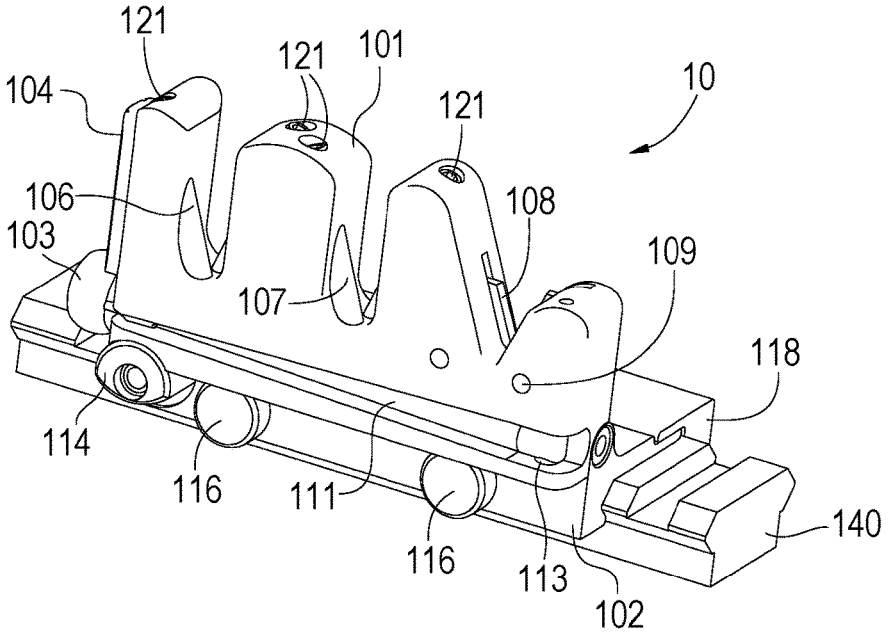
FIG. 3 is an upper perspective view of the rail mounted sharpening device mounted to a rail.

As may be seen more clearly in FIG. 2 housing body 101 is pivotally mounted to base 102 along an axis extending along a sharpener housing rotation locking screw 123, which is received in sharpener housing rotation locking screw threaded shaft 119. The rotation locking screw has a knob end 103 extending from housing body 101 for access to enable the locking screw 123 to be loosened for selective movement between the work position shown in FIGS. 1 to 3 and the closed position shown in FIG. 4. A modified disc rotation locking wheel 114 is also mounted to base 102 and at can be rotated to lock and unlock the rotation of the housing in both the open (upright) and closed (laid down) positions. The full edge of the wheel 114 rotated vertically along any part of its circumference will block and lock the housing's rotation. To free the rotation, the wheel 114 is rotated until the opposite side of the wheel which has a diminished radius, is turned upwardly, such that it does not contact the housing body 101 and allows movement between the open and closed positions.

Again as seen in FIG. 2, sharpener housing rail-mounting base 102 includes an opposing side forming a sharpener housing rail-mounting base clamp 118 which forms the opposite side of rail receiver 105. A pair of sharpener base rail locking screws 116 pass through the base 102 and receiver 105 and screw into threaded inserts 122, shown in FIG. 4A. It will be appreciated from FIG. 3 that the rail 140 inserted into receiver 105 is formed with a number of crests and valleys such that the rail locking screws 116 can be inserted to engage appropriate valleys and lock the base 102 to rail 140 in a well-known manner. Of course, the rail and receiver may be locked by other means such as with locking pins as is well known. Rail 140 may be configured a MIL-STD-1913 rail, a 2324 rail, a Picatinny rail, a tactical rail, a Weaver rail, a STANAG 4694 NATO Accessory Rail (NAR), and/or any other rail-mounting platform of similar configuration. It is understood that these rail configurations are well known in the firearms industries and allow the sharpener to be readily mounted to a firearm. As will be discussed further, the sharpener may likewise be rail mounted to objects other than a firearm.

Figure 4A:
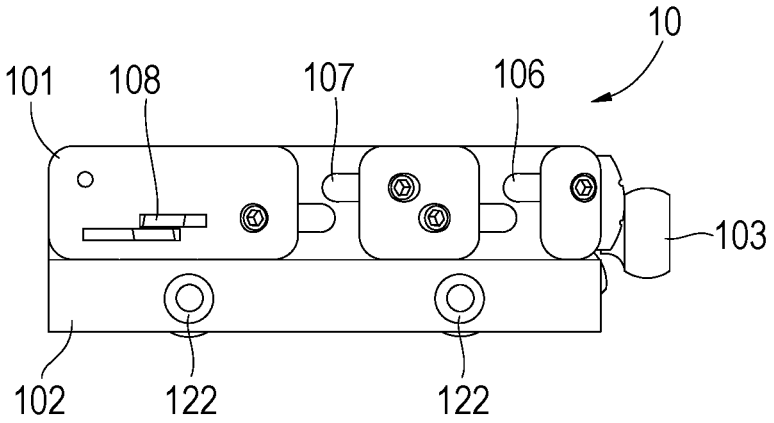
FIG. 4A is a side elevation view of the rail mounted sharpening device in a closed position from the side opposite the view shown in FIG. 4.

Referring to FIG. 4, it may be seen that the housing body 101 folds down on base 102 when mounted for storage on a rail. Referring to FIG. 5, housing body 101 is shown in its folded position, with tapered rod 111 and retention lip 112 visible above rotating locking screw knob 103. Diamond hook sharpening panel 104 with two tapered diamond coated grooves 126 is also shown.

Figure 7:
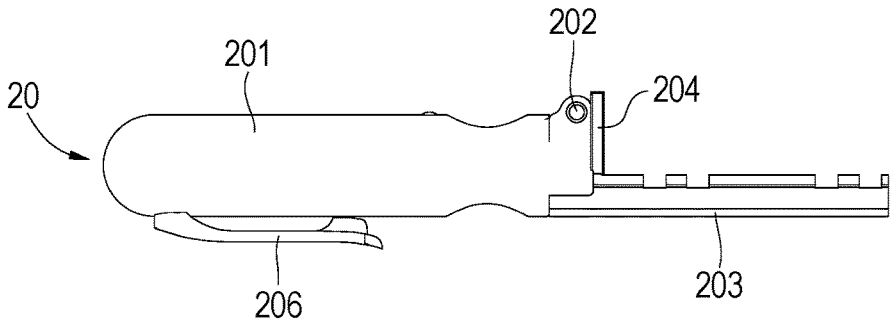
FIG. 7 is a side elevational view of a handle and rail for the rail mounted sharpening device.
Figure 8:
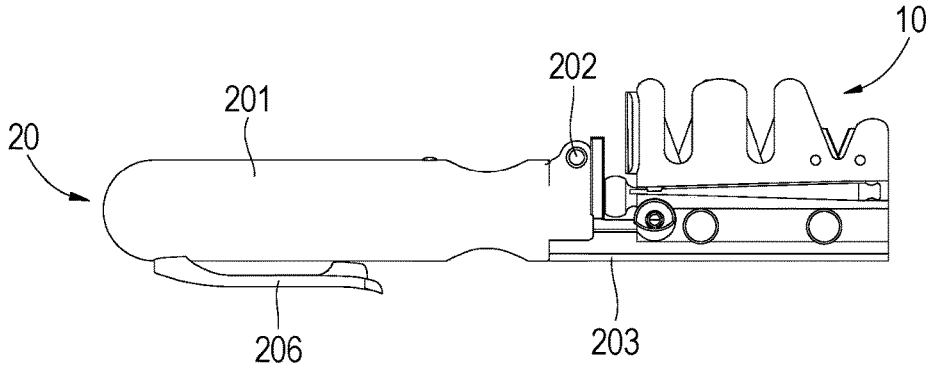
FIG. 8 is a side elevation view of the rail mounted sharpening device mounted to the handle shown in FIG. 7.
Figure 9:
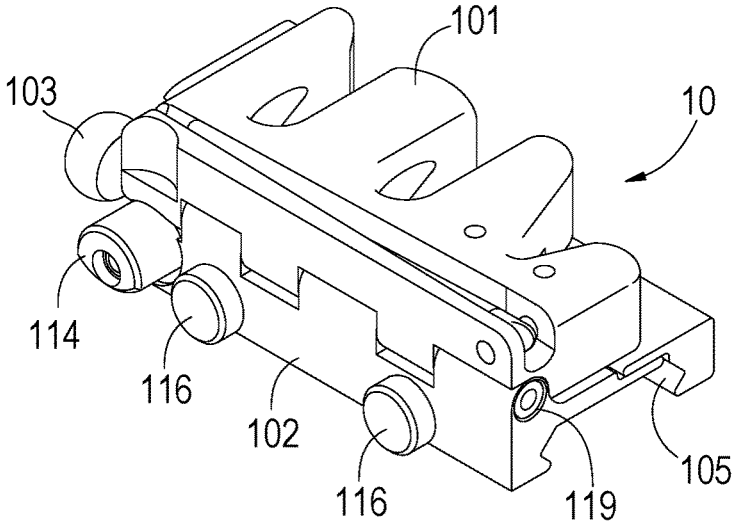
FIG. 9 is a perspective view of the rail mounted sharpening device in a closed position.
Figure 10:
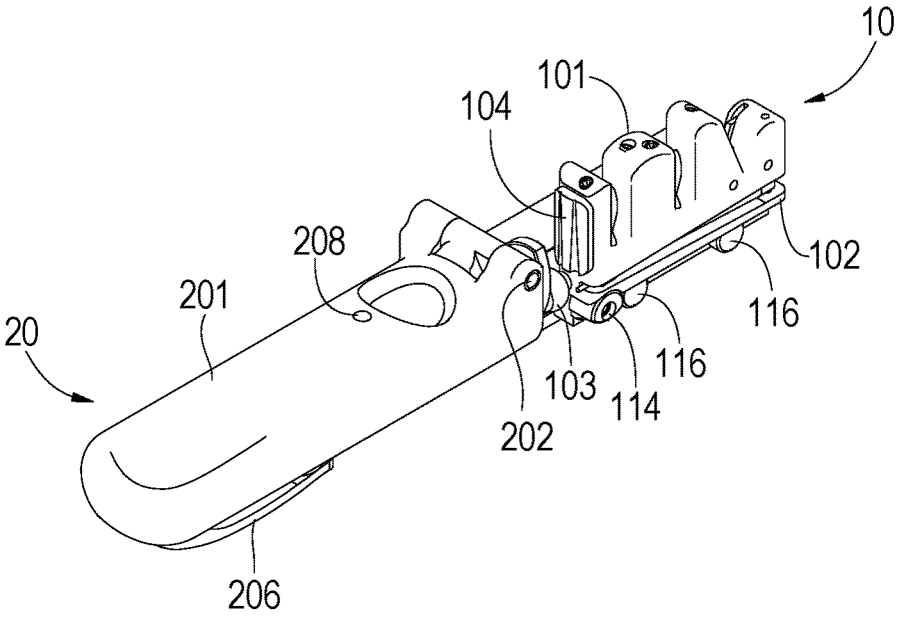
FIG. 10 is a perspective view of the rail mounted sharpening device mounted to its handle
Figure 11:
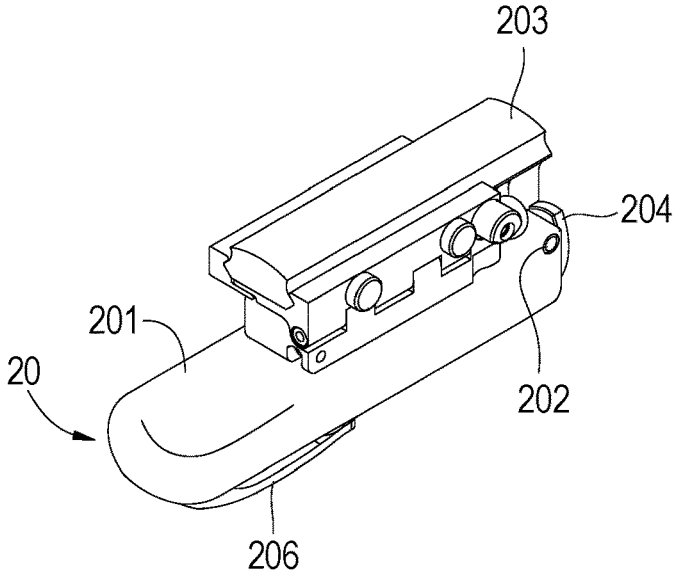
FIG. 11 is a perspective view of the rail mounted sharpening device mounted to the rail handle in folded position.
Figure 12:
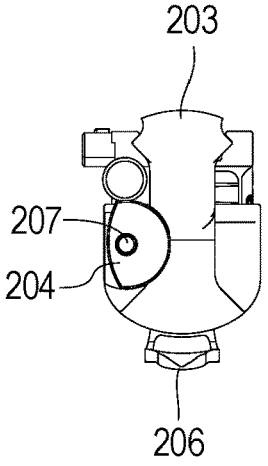
FIG. 12 is an end view of the rail mounted sharpening device mounted to the rail handle in a folded position.

Referring to FIGS. 7 and 8 an optional knife and tool sharpener handle 20 is provided including handle body 201 carrying a sharpener handle pivot pin 202, on which is mounted the sharpener handle rail 203, the sharpener handle rail locking wheel 204, the sharpener handle clip 206, and the sharpener handle rail locking wheel screw 207, shown in FIG. 12, which retains the locking wheel 204. As may be seen in FIGS. 8, 9, and 10, the assembly 10 is attached to the sharpener handle rail 203 in exactly the same manner as the assembly is attached to a weapon mounted rail, however, the handle body 201 allows much more maneuverability and ease of use. The assembly 10 may be collapsed or folded as shown in FIGS. 11 and 12. Rotating locking wheel 204 will allow rail 203 to pivot around pin 202 and the folded assembly 10 may be brought into a stored position resting on detent 208, shown in FIG. 10. Locking wheel 204 may then be repositioned to retain the assembly 10 in the stored position.

Figure 13:
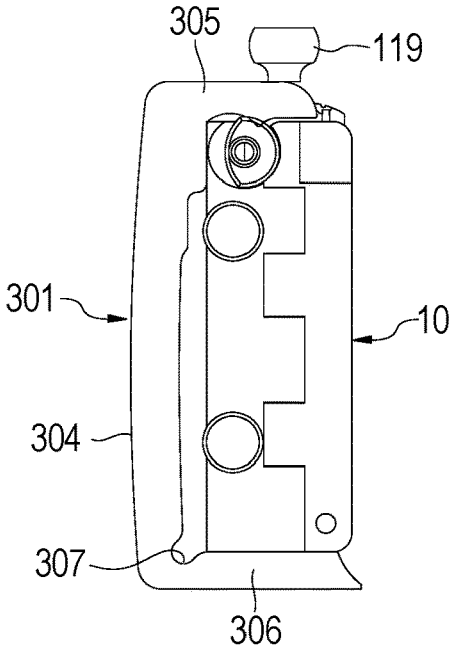
FIG. 13 is a side elevation view of the rail mounted sharpening device secured in the PALS configured carrier clip.
Figure 14:
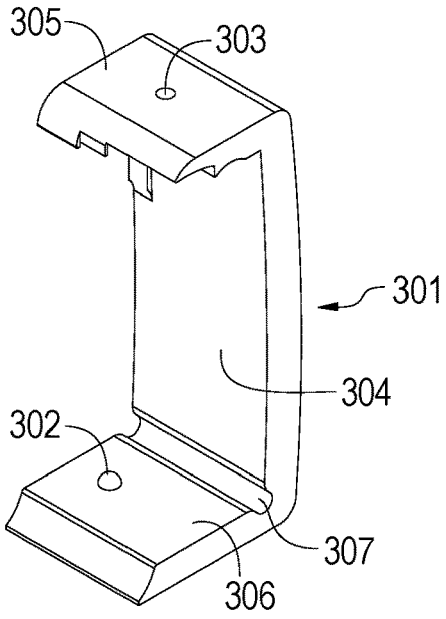
FIG. 14 is a perspective view of the PALS carrier clip.

Referring to FIGS. 13 and 14, note that assembly 10 may be secured in the PALS sharpener carrier 301. The carrier has a detent 302 in the bottom foot 306 that aligns with the opening in the threaded shaft 119 to aid in positioning alignment. When in place, the rotation locking screw 123, having been removed prior to insertion into the carrier, passes through an alignment hole 303 in the top 305 of the carrier and screws down into the threaded shaft 119 in the sharpener base, securing it to the carrier.

There is clearance space allowed for between the inside face of the carrier body 304 and the sharpener itself for webbing to pass and be secured to on the PALS grid on vests, packs, etc. To attach the carrier 301 to a vest or pack, the bottom foot 306 of the carrier passes behind the webbing and the carrier is rotated vertically into position to accept the sharpener housing. The radiused cutout 307 in the lower body of the carrier 301 allow for some slight flexing to occur when the base is positioned into engagement.

Figure 15:
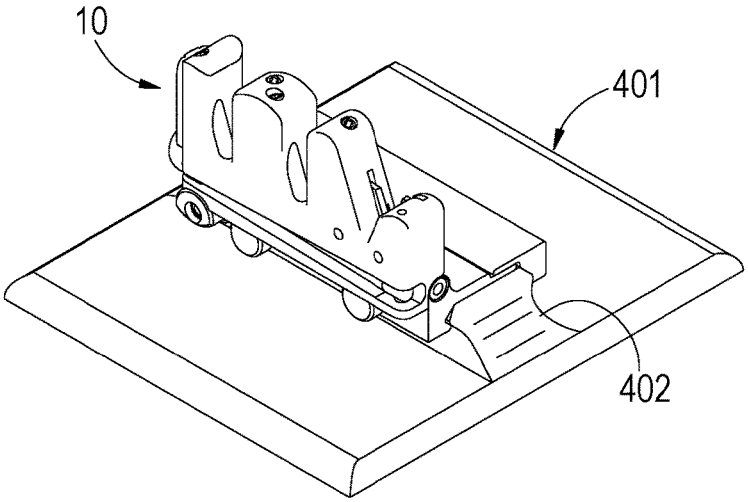
FIG. 15 is a perspective view of the rail mounted sharpening device mounted to an integral rail base.

Referring to FIG. 15, it may be seen that the versatile tool may be attached to a mounting pad 401 for use on a table top, on a surface on a vehicle or any other similar mounting platform. Pad 401 has an integral rail 402 that is used to secure the assembly 10 in the same manner as the aforementioned rails and may be likewise configured. It will be readily understood that pad 401 may be conventionally secured or may have a tacky lower surface that prevents its movement while the tool is in use.

While in the foregoing specification this invention has been described in relation to certain embodiments thereof, and many details have been put forth for the purpose of illustration, it will be apparent to those skilled in the art that the invention is susceptible to additional embodiments and that certain of the details described herein can be varied considerably without departing from the basic principles of the invention.

What I claim is:

1. An apparatus for sharpening tools, comprising:

a. a sharpener housing body having a plurality of sharpening tools affixed thereto for selective use in sharpening objects;

b. a sharpener housing body rail-mounting base, hingedly connected to said sharpener housing body for selective positioning of said body between a stored position and a use position, said rail-mounting base defining a rail receiver extending through a lower portion thereof; and c. a firearm accessory mounting rail in mating engagement with said rail receiver of said rail-mounting base, said firearm accessory mounting rail selected from the group consisting of a Picatinny rail, a MIL-STD-1913 rail, a Weaver rail, and a STANAG 4694 NATO Accessory Rail.

2. An apparatus as defined in claim 1 wherein said sharpening tools comprise one or more tools selected from the group of fine abrasive ceramic sharpening sticks, coarse abrasive ceramic sharpening sticks, diamond abrasive rods, beveled carbide inserts, and a diamond hook sharpening panel.

3. An apparatus as defined in claim 2 wherein said sharpener housing body supports at least one pair of abrasive ceramic sharpening sticks in fixed converging relationship at an included angle suitable for sharpening blades by drawing said blades between said abrasive ceramic sharpening sticks.

4. An apparatus as defined in claim 3 wherein said sharpener housing body defines a longitudinally extending recess opening laterally of said body wherein a tapered diamond abrasive rod is mounted by a pivot pin extending through one end thereof such that an opposite end of said abrasive rod can be selectively pivoted outwardly from said recess, said body forming a retaining lip adjacent said recess for selectively retaining said abrasive rod within said recess.

5. An apparatus for sharpening tools, comprising:

a. a sharpener housing body having a plurality of sharpening tools affixed thereto for selective use in sharpening objects;

b. a sharpener housing body rail-mounting base, hingedly connected to said sharpener housing body for selective positioning of said body between a stored position and a use position, said rail-mounting base defining a rail receiver extending through a lower portion thereof, said rail receiver configured for mating engagement with a mounting rail; and c. a handle and a handle rail connected thereto such that said sharpener housing body rail-mounting base receives said handle rail therein.

6. An apparatus as defined in claim 5 wherein said handle and said handle rail are pivotally connected such that said handle rail may be pivoted between an open position and a folded position relative to said handle, said handle rail being selectively secured in said open position or said folded position by locking wheel carried by said handle.

7. An apparatus as defined in claim 6 wherein said sharpener housing body in said stored position is proximate said handle when said handle rail is in said folded position.

8. An apparatus as defined in claim 5 wherein said sharpening tools comprise one or more tools selected from the group of fine abrasive ceramic sharpening sticks, coarse abrasive ceramic sharpening sticks, diamond abrasive rods, beveled carbide inserts, and a diamond hook sharpening panel.

9. An apparatus as defined in claim 5 wherein said sharpener housing body defines a longitudinally extending recess opening laterally of said body wherein a tapered diamond abrasive rod is mounted by a pivot pin extending through one end there of such that an opposite end of said abrasive rod can be selectively pivoted outwardly from said recess, said body forming a retaining lip adjacent said recess for selectively retaining said abrasive rod within said recess.

10. An apparatus as defined in claim 5 wherein said sharpener housing body supports at least one pair of abrasive ceramic sharpening sticks in fixed converging relationship at an included angle suitable for sharpening blades by drawing said blades between said abrasive ceramic sharpening sticks.

11. An apparatus for sharpening tools, comprising:

a. a sharpener housing body having a plurality of sharpening tools affixed thereto for selective use in sharpening objects;

b. a sharpener housing body rail-mounting base, hingedly connected to said sharpener housing body for selective positioning of said body between a stored position and a use position, said rail-mounting base defining a rail receiver extending through a lower portion thereof, said rail receiver configured for mating engagement with a mounting rail; and c. a mounting pad suitable for placement on a supporting surface and a rail, affixed to said mounting pad, engageable within said rail receiver for selectively mounting said sharpener housing body rail-mounting base and sharpener housing body on said mounting pad.

12. An apparatus for sharpening tools, comprising:

a. a sharpener housing body having a plurality of sharpening tools affixed thereto for selective use in sharpening objects;

b. a sharpener housing body rail-mounting base, hingedly connected to said sharpener housing body for selective positioning of said body between a stored position and a use position, said rail-mounting base defining a rail receiver extending through a lower portion thereof, said rail receiver configured for mating engagement with a mounting rail; and c. a carrier for said sharpener housing body rail-mounting base and sharpener housing body, said carrier including a carrier top, carrier bottom foot and carrier body forming a generally C shaped carrier, said carrier having a hole in said carrier top and a detent on said carrier bottom foot which align with the hinged connection of said sharpener housing body rail-mounting base to said sharpener housing body to secure said carrier thereto.

13. An apparatus as defined in claim 12 wherein said sharpener housing body rail-mounting base is hingedly connected to said sharpener housing body about a removable rotation locking screw which engages a threaded shaft commonly carried by said sharpener housing body rail-mounting base and said sharpener housing body.

14. An apparatus as defined in claim 13 wherein said removable rotation locking screw passes through said hole in said carrier top to engage said threaded shaft and said detent on said carrier bottom foot engages an opposite end of said threaded shaft to secure said carrier in place.

15. An apparatus for sharpening tools, comprising:

a. a sharpener housing body having a plurality of sharpening tools affixed thereto for selective use in sharpening objects; and b. a sharpener housing body rail-mounting base, hingedly connected to said sharpener housing body for selective positioning of said body between a stored position and a use position, said rail-mounting base defining a rail receiver extending through a lower portion thereof, said rail receiver configured for mating engagement with a mounting rail;

c. wherein said sharpener housing body rail-mounting base is hingedly connected to said sharpener housing body about a removable rotation locking screw commonly carried by said sharpener housing body rail-mounting base and said sharpener housing body.

16. An apparatus as defined in claim 15 wherein said sharpener housing body defines a longitudinally extending recess opening laterally of said body wherein a tapered diamond abrasive rod is mounted by a pivot pin extending through one end there of such that an opposite end of said abrasive rod can be selectively pivoted outwardly from said recess, said body forming a retaining lip adjacent said recess for selectively retaining said abrasive rod within said recess.

17. An apparatus as defined in claim 16 wherein said sharpener housing body supports at least one pair of abrasive ceramic sharpening sticks in fixed converging relationship at an included angle suitable for sharpening blades by drawing said blades between said abrasive ceramic sharpening sticks.

18. An apparatus as defined in claim 17 wherein said sharpener housing body supports at least one pair of beveled carbide inserts in fixed converging relationship at an included angle suitable for sharpening blades by drawing said blades between said carbide inserts.

19. An apparatus as defined in claim 18 further comprising at least one diamond hook sharpening panel mounted to one end of said sharpener housing body.

20. An apparatus as defined in claim 19 further comprising at least one hook sharpening groove formed in said hook sharpening panel.

21. An apparatus for sharpening tools, comprising:

a. a sharpener housing body having at least one sharpening tool affixed thereto for use in sharpening objects;

b. a sharpener housing body rail-mounting base having a rail receiver extending through a lower portion thereof, said rail receiver formed by a first side member and an opposing second side member secured to each other with at least one locking fastener; and c. a firearm accessory mounting rail reversibly secured within said rail receiver between said first side member and said opposing second side member, said firearm accessory mounting rail having a plurality of crests and a plurality of valleys;

d. wherein said at least one locking fastener is operable to secure said first side member to said opposing second side member through one of said plurality of valleys and thereby reversibly clamp said sharpener housing body rail-mounting base to said firearm accessory mounting rail.

22. An apparatus as defined in claim 21 wherein said sharpener housing body rail-mounting base is hingedly connected to said sharpener housing body for selective positioning of said body between a stored position and a use position.

23. An apparatus as defined in claim 22 wherein said sharpener housing body rail-mounting base is hingedly connected to said sharpener housing body about a removable rotation locking screw commonly carried by said sharpener housing body rail-mounting base and said sharpener housing body.

24. An apparatus as defined in claim 21 wherein said at least one sharpening tool is selected from the group consisting of fine abrasive ceramic sharpening sticks, coarse abrasive ceramic sharpening sticks, diamond abrasive rods, beveled carbide inserts, and a diamond hook sharpening panel.

25. An apparatus as defined in claim 21 wherein said firearm accessory mounting rail is selected from the group consisting of a Picatinny rail, a MIL-STD-1913 rail, a Weaver rail, and a STANAG 4694 NATO Accessory Rail.

* * * * *